US006029357A

United States Patent [19]

Morton

[11] Patent Number: 6,029,357

[45] Date of Patent: Feb. 29, 2000

[54] KNIFE HAVING LANYARD BORE IN THE KNIFE HANDLE PERIPHERY

[75] Inventor: Randolph J. Morton, Coronado, Calif.

[73] Assignee: Buck Knives, Inc., El Cajon, Calif.

[21] Appl. No.: 09/013,075

[22] Filed: Jan. 26, 1998

[51] Int. Cl.[7] ..... B26B 1/10

[52] U.S. Cl. ..... 30/298.4; 30/340

[58] Field of Search ..... 30/294.4, 298, 30/296.01, 297, 251, 254, 340, 151, 155; 16/114 B, 114 R; 7/118–120

[56] References Cited

U.S. PATENT DOCUMENTS 1,665,256 4/1928 Goertz et al. ..... 30/298.4 X
2,846,714 8/1958 Charlick ..... 16/114 B
4,442,559 4/1984 Collins .
4,622,707 11/1986 Finn .
4,877,167 10/1989 McNemar .
4,985,998 1/1991 Howard ..... 30/155 X
5,704,129 1/1998 Glesser .

*Primary Examiner*—Douglas D. Watts
*Attorney, Agent, or Firm*—Gregory Garmong

[57] ABSTRACT

A knife handle has a handle periphery when viewed in blade elevational view and has a butt end. A blade is attached to the knife handle. A bore extends through the knife handle from a first location on the handle periphery adjacent to the butt end, through an interior of the knife handle, and to a second location on the handle periphery adjacent to the butt end. The bore is preferably curved, with an included angle of the bore axis at its openings of from about 35 to about 45 degrees. A lanyard passes through the bore.

19 Claims, 3 Drawing Sheets

KNIFE HAVING LANYARD BORE IN THE KNIFE HANDLE PERIPHERY

BACKGROUND OF THE INVENTION

This invention relates to knives, and, more particularly, to a knife with a lanyard and the structure by which the lanyard is attached to the knife.

A knife generally includes a knife handle and a blade extending from the knife handle at a position remote from the butt end of the knife handle. The blade may be either fixed or foldable into the knife handle. When in service, the knife is grasped by one hand of the user. When not in service, the knife may be carried on the person of the user, either in a pocket or a pouch, or otherwise affixed to the body of the user.

One approach to affixing the knife to the body of the user, either during service or for storage, is a length of a flexible material such as cotton string, leather, or rubber. This flexible material is generally termed a "lanyard". Lanyards are widely used with specialty underwater knives and for many knives intended for more-conventional applications.

The lanyard must be reliably attached to the knife. In conventional practice, the lanyard is either attached directly to the knife handle or to a ring or other structure which is in turn attached to the knife handle. When the lanyard is attached directly to the knife handle, it extends through a hole between the lateral sides of the knife handle.

In either case, the portion of the lanyard away from the knife handle often twists onto itself in a FIG.-8 or other form that makes the use of the lanyard difficult. The ring structure or openings of the ends of the lanyard hole are unsightly for many applications, as they visually interfere with the appearance of the lateral sides of the knife. The appearance of the lateral sides is an important consideration for many utilitarian knife users and also for collectors.

There is a need for an improved approach to the use of lanyards with knives. The present invention fulfills this need, and further provides related advantages.

SUMMARY OF THE INVENTION

The present invention provides a knife suitable for use with a lanyard. The attachment of the lanyard to the knife reduces the tendency of the lanyard to twist in service. The attachment of the lanyard to the knife is visually less obtrusive than conventional lanyard attachments, and does not interfere with the appearance of the lateral sides of the knife. The attachment is readily formed in the handle of molded knife handles.

In accordance with the invention, a knife comprises a knife handle having a handle periphery when the knife handle is viewed in blade elevational view and further having a butt end. A blade is attached to the knife handle at a location remote from the butt end, typically either fixedly or with a pivoting mechanism. A bore extends through the knife handle from a first location on the handle periphery adjacent to the butt end, through an interior of the knife handle, and to a second location on the handle periphery adjacent to the butt end. A lanyard extends through the bore.

In most cases, the knife handle has a narrow dimension when measured parallel to a width axis and a long dimension when measured along a longitudinal axis through the knife handle and the blade. The ends of the bore are not visible when the handle is viewed along the width axis. The ends of the bore are visible when the axis is viewed along the longitudinal axis from the butt end.

The bore may be either straight or curved. Most preferably, the bore is curved such that there is an included angle of less than 180 degrees between a bore axis at the first location and the bore axis at the second location. The included angle is more preferably from about 30 degrees to about 60 degrees, and most preferably from about 35 degrees to about 45 degrees.

The knife handle of the invention is most conveniently constructed with a molded left sidepiece and a molded right sidepiece. The bore is defined by a left-side recess in the left sidepiece and a flat surface on the right sidepiece. Alternatively, the bore may be defined by a left-side recess in the left sidepiece and a right-side recess in the right sidepiece, so that the left-side recess and the right side recess are in registry when the left sidepiece and the right sidepiece are assembled together. In yet another approach, the bore is molded into a one-piece knife handle using an insert positioned in the mold.

The bore structure of the invention serves to inhibit the lanyard, and thence the knife, from twisting when the knife is supported from the lanyard. Or, conversely, the lanyard tends to twist very little if the knife is held and the lanyard is allowed to dangle. The bore and bore end openings are substantially not visible and not noticeable when the knife is viewed from the side, in blade elevational view. The presence of the bore therefore does not visually detract from the appearance and decoration of the lateral sides of the knife.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
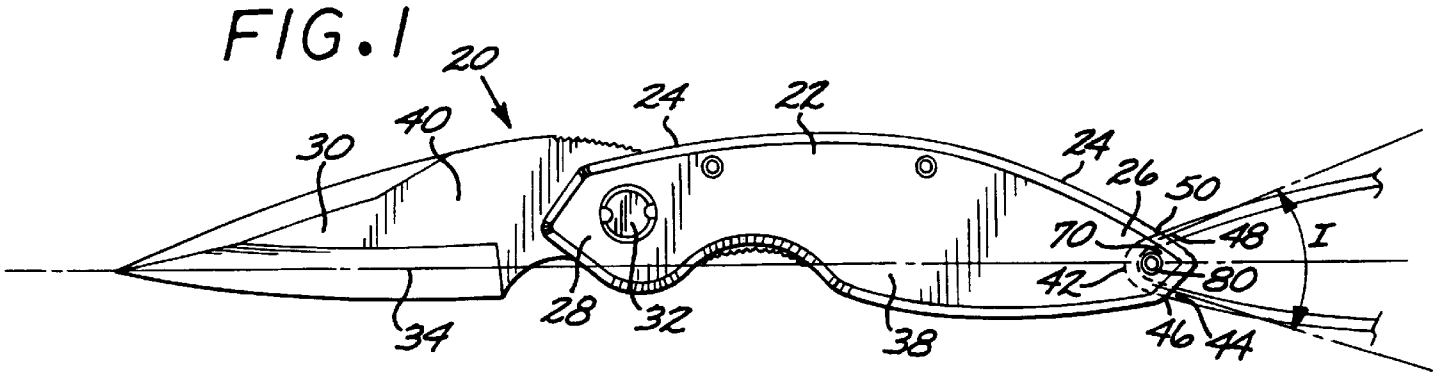
FIG. 1 is a blade elevational view of a knife, with a lanyard bore according to the invention shown in phantom lines.
Figure 2:
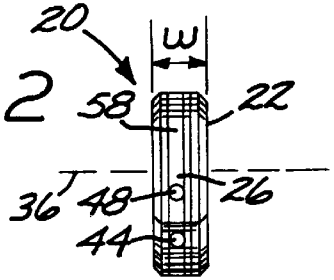
FIG. 2 is an end view of the knife of FIG. 1, taken parallel to the knife longitudinal axis from the butt end of the knife.
Figure 3:
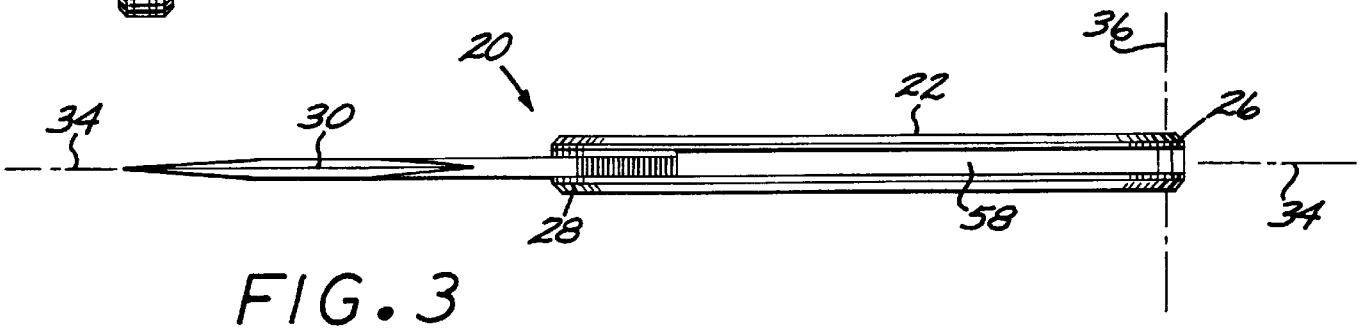
FIG. 3 is a top view of the knife of FIG. 1.

FIGS. 1–3 depict a knife 20 according to the invention. The knife 20 includes a knife handle 22 having a handle periphery 24 when viewed in the blade elevational view of FIG. 1. The knife handle 22 and the handle periphery 24 have a butt end 26 and a blade-attachment end 28 remote from the butt end. A blade 30 is attached to the knife handle 22 at the blade-attachment end 28, in this embodiment by a rotational mechanism whose pivot 32 may be seen in FIG. 1. The rotational mechanism allows the blade 30 to pivot between the illustrated open position and a closed position wherein the blade lies between the sides of the knife handle 22, the familiar "pocket knife" construction. The knife 20 has a knife longitudinal axis 34 through the long direction of the knife handle 22 and the blade 30. FIG. 2 is a view of the same knife 20 in the direction parallel to the knife longitudinal axis 34, taken from the butt end of the knife. The knife handle 22 has a narrow dimension W measured along a width axis 36 that is perpendicular to the longitudinal axis 34.

As used herein, the "blade elevational view" is the view of FIG. 1, illustrating in full view a broad, flat lateral side 38 of the knife handle 22 and a flat side 40 of the blade 30. The handle periphery 24 is also visible in this blade elevational view. Stated equivalently, the blade elevational view is the view taken parallel to (along) the width axis 36 of FIGS. 2 and 3.

The knife 20 further includes a bore 42 through the knife handle 22 at a location immediately adjacent to the butt end 26 of the knife handle 22. The location of the bore 42 is shown in phantom lines in FIG. 1, as it is not externally visible in this view. The bore 42 has a first end 44 at a first location 46 on the handle periphery 24, and a second end 48 at a second location 50 on the handle periphery 24. The first end 44 and the second end 48 of the bore 42 are not substantially visible in the blade elevational view of FIG. 1, but they are, however, visible in the butt-end view of FIG. 2. A small portion of the ends 44 and 48 may be very slightly visible in the blade elevational view of FIG. 1, if the handle periphery 24 is curved for a comfortable feel in the hand of the user. The entire ends 44 and 48 are not visible in the blade elevational view of FIG. 1.

The orientation of the bore 42 may be defined by a first bore axis 52 at the first end 44 and a second bore axis 54 at the second end 48. An included angle I is defined between the first bore axis 52 and the second bore axis 54. In the embodiment of FIG. 1, the included angle I is less than 180 degrees. Preferably, the included angle I is from about 30 to about 60 degrees. Most preferably, the included angle I is from about 35 to about 45 degrees. A lanyard 56 is typically threaded through the bore 42 and knotted at a location outside the field of view, to make a continuous loop. (The lanyard 56 overlies and coincides with the bore axes 52 and 54 at the respective ends 44 and 48, but then typically diverges from those axes at positions further from the butt end 28.) The preferred and most preferred included angles I are found to provide the best stability against twisting of the lanyard when in service.

Figure 5B:
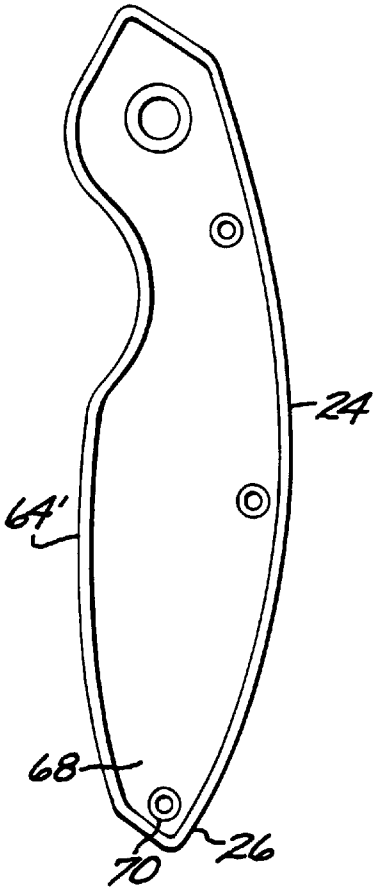
FIG. 5B is an elevational view of the inside surface of a second embodiment of the right sidepiece of the knife of FIG. 1.
Figure 5A:
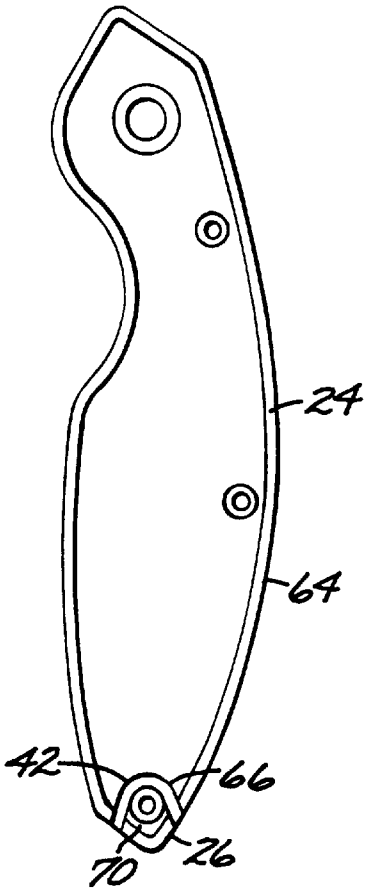
FIG. 5A is an elevational view of the inside surface of a first embodiment of the right sidepiece of the knife of FIG. 1.
Figure 4:
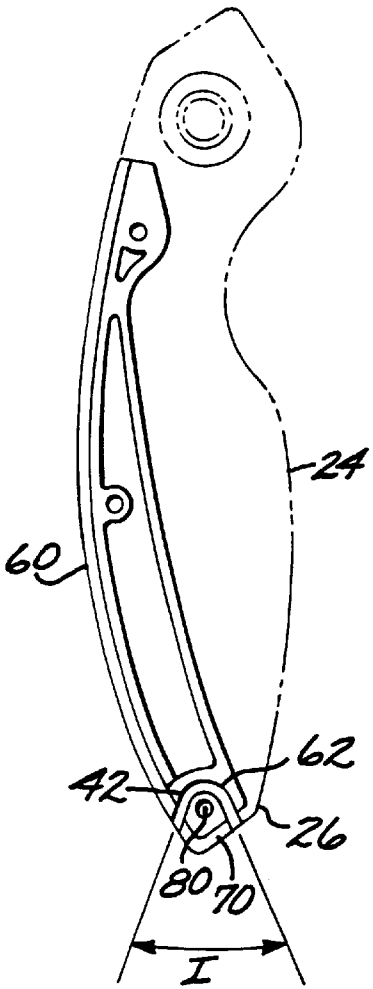
FIG. 4 is an elevational view of the inside surface of the left sidepiece of the knife of FIG. 1.

FIGS. 4 and 5A–B illustrate the preferred constructional approach for the knife and knife handle having the bore 42. In this embodiment, the knife handle 22 is formed as two sidepieces, which are joined together in a facing relationship with a blade tang or support structure 58 (seen in FIGS. 2 and 3) between them. Each of the sidepieces has a matching recess therein, so that, when the sidepieces are brought into registry, the two recesses together define the bore 42. FIG. 4 illustrates a left sidepiece 60 having a left-side recess 62 therein. The left-side recess 62 defines one side of the bore 42. FIG. 5A illustrates a right sidepiece 64 having a right-side recess 66 therein. The right-side recess 66 defines the second side of the bore 42. The sidepieces 60 and 64 are assembled together in a facing relationship (with the blade tang or support structure 58 therebetween), so that the recesses 62 and 66 are in a facing relationship and cooperatively define the bore 42.

In an alternative embodiment, only one of the sidepieces has a recess therein, and the other is flat. For example, the left sidepiece 60 is as shown in FIG. 4, and the right sidepiece 64' is as shown in FIG. 5B. In this embodiment, the right sidepiece 64' is a flat surface 68, with no right-side recess. The bore 42 is formed by the left-side recess 62, closed on its right side by the flat surface 68. Equivalently, the recess may be in the right sidepiece with the facing region of the left sidepiece flat. The bore formed by this approach is not symmetric in cross section but is operable for many applications. The embodiment of FIGS. 4 and 5B is easier to manufacture, because it is not necessary to achieve a precise registration of two recesses.

In either of the two described embodiments illustrated in FIGS. 4 and 5A–B, the sidepieces 60 and 64 are preferably manufactured by a molding operation, most preferably injection molding. The recesses 62 and 66 (where present) are readily provided in the mold. A butt region 70, at a location within the arc subtended between the two axes 52 and 54, is defined in the mold as well, giving excellent strength to the structure forming the bore 42.

In either of the two described embodiments of FIGS. 4 and 5A–B, an attachment such as a rivet 80 is preferably positioned through the sidepieces 60 and 64, and the tang or support structure 58, in the butt area 70. The rivet 80, in cooperation with other rivets, holds the structure together and also strengthens the butt region 70 into which lanyard loads are transmitted.

The knife handle may instead be formed as a single piece, with the bore 42 extending therethrough. If the one-piece knife handle is molded, the bore 42 may be formed using a removable insert that is present during the molding and subsequently removed before service. Such techniques are known in the art. A rivet within the arc subtended by the axes is also desirably provided in this embodiment.

Figure 6:
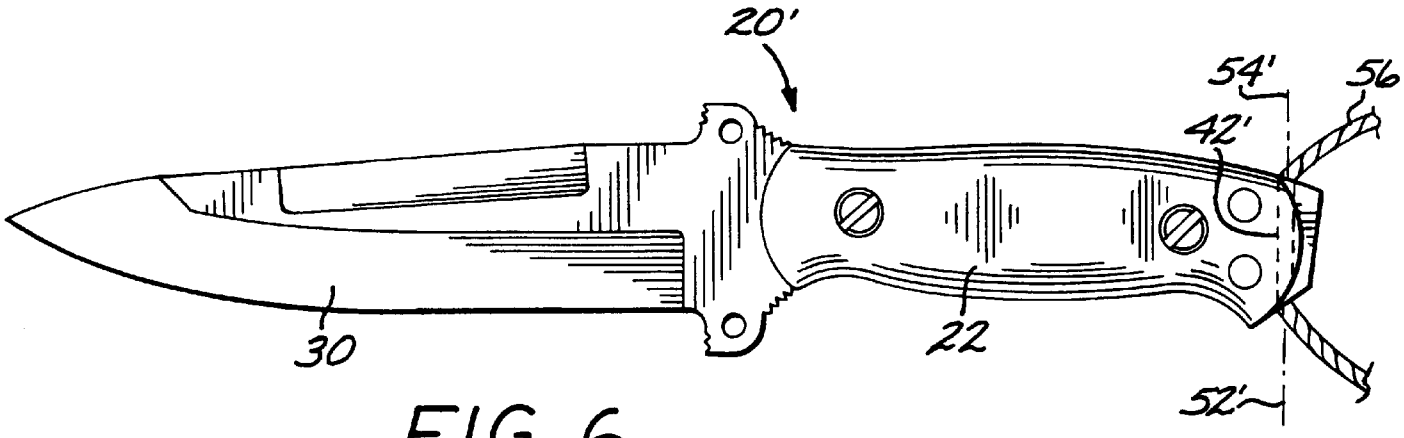
FIG. 6 is a blade elevational view of another embodiment of the knife of the invention, with a lanyard bore according to the invention shown in phantom lines.

FIG. 6 illustrates another embodiment of the knife 20' with a bore 42' therein. The knife 20' is similar to the knife 20 described previously, with two major differences. The prior discussion is incorporated otherwise. The differences are that, first, the knife 20' is a fixed blade knife. Second, the bore 42' is straight, so that the first bore axis 52' and the second bore axis 54' are parallel and coincident. The features of the embodiments of FIGS. 1 and 6 may be used in any compatible manner; for example, the curved bore 42 may be used with a fixed blade knife and the straight bore 42' may be used with a folding-blade knife. If the knife handle is not molded, it may be desirable to use the straight-bore embodiment, which is readily formed with a drilling operation.

Figure 7:
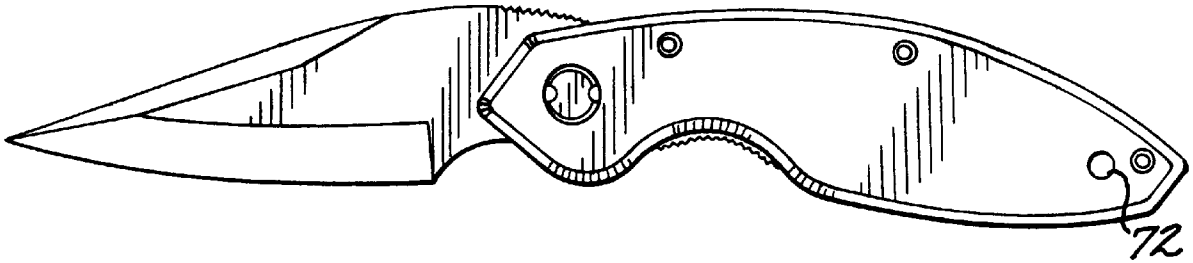
FIG. 7 is a blade elevational view of a knife with a conventional lanyard attachment.

FIG. 7 illustrates a conventional approach to attaching a lanyard to a knife, which is contrasted with the present approach. An opening 72 is formed so as to be visible in the blade elevational view, and does not extend between two locations on the periphery of the handle. That is, the opening 72 extends through the knife handle parallel to the width axis 36 (which extends perpendicular to and out of the plane of the drawing in FIG. 7) through the smallest dimension of the knife handle. This approach has the shortcomings that the opening 72 is visible on the lateral side of the handle 38 in the blade elevational view of FIG. 6, impairing the visual continuity and appearance of the lateral side of the handle. While no decoration is shown in FIG. 7, it is common practice to apply decoration or patterning to the lateral sides of the handles, the presence of the opening 72 interferes with that decoration or patterning. Secondly, it has been found that the lanyard tends to twist more easily when the opening 72 is used, as compared with the bore 42 of the approach of the invention.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A knife, comprising:

a knife handle having a narrow dimension when measured parallel to a width axis and further having a butt end, the knife handle further having a handle periphery when the knife handle is viewed along the width axis;

a blade attached to the knife handle at a location remote from the butt end; and a bore through the knife handle, the bore extending from a first location on the handle periphery adjacent to the butt end, through an interior of the knife handle, and to a second location on the handle periphery adjacent to the butt end, and wherein the bore is not parallel to the width axis.

2. The knife of claim 1, wherein the bore is curved, such that a bore axis at the first location is not parallel to the bore axis at the second location.

3. The knife of claim 1, wherein the bore is straight, such that a bore axis at the first location is parallel to and coincident with the bore axis at the second location.

4. The knife of claim 1, wherein the bore is curved, such that there is an included angle of less than 180 degrees between a bore axis at the first location and the bore axis at the second location.

5. The knife of claim 4, wherein the included angle is from about 30 degrees to about 60 degrees.

6. The knife of claim 4, wherein the included angle is from about 35 degrees to about 45 degrees.

7. The knife of claim 1, further including a lanyard passing through the bore.

8. The knife of claim 1, wherein the blade is attached to the knife handle by a pivoting mechanism.

9. The knife of claim 1, wherein the blade is fixedly attached to the knife handle.

10. The knife of claim 1, wherein the knife handle comprises a left sidepiece and a right sidepiece, and the bore is defined by a left-side recess in the left sidepiece and a right-side recess in the right sidepiece, the left-side recess and the right side recess being in registry when the left sidepiece and the right sidepiece are assembled together.

11. The knife of claim 1, wherein the knife handle comprises a left sidepiece and a right sidepiece, and the bore is defined by a recess in one of the left sidepiece and the right sidepiece, and a flat surface on the other of the sidepieces.

12. The knife of claim 1, wherein the knife handle comprises a molded left sidepiece and a molded right sidepiece.

13. A knife, comprising:

a knife handle having a narrow dimension when measured parallel to a width axis and further having a butt end;

a blade attached to the knife handle at a location remote from the butt end; and a bore through the knife handle adjacent to the butt end, the bore having a first end and a second end which are not visible when the handle is viewed along the width axis and the bore is not parallel to the width axis, wherein the bore is curved, such that there is an included angle of less than 180 degrees between a bore axis at the first end and a bore axis at the second end.

14. The knife of claim 1, wherein the included angle is from about 30 degrees to about 60 degrees.

15. The knife of claim 1, wherein the included angle is from about 35 degrees to about 45 degrees.

16. The knife of claim 13, further including a lanyard passing through the bore.

17. The knife of claim 13, wherein the knife handle comprises a left sidepiece and a right sidepiece, and the bore is defined at least in part by a recess in one of the left sidepiece and the right sidepiece.

18. The knife of claim 13, wherein the knife handle comprises a molded left sidepiece and a molded right sidepiece.

19. A knife, comprising:

a knife handle having a narrow dimension when measured parallel to a width axis and further having a butt end;

a blade attached to the knife handle at a location remote from the butt end, there being a knife longitudinal axis perpendicular to the width axis through the knife handle and the blade; and a bore through the knife handle adjacent to the butt end, the bore having a first end and a second end which are visible when the knife handle is viewed from the butt end along the knife longitudinal axis, and wherein the bore is not parallel to the width axis.

* * * * *